US009856843B2

(12) United States Patent
Schuerz

(10) Patent No.: US 9,856,843 B2
(45) Date of Patent: Jan. 2, 2018

(54) FLUID INJECTOR

(71) Applicant: Continental Automotive GmbH, Hannover (DE)

(72) Inventor: Willibald Schuerz, Pielenhofen (DE)

(73) Assignee: CONTINENTAL AUTOMOTIVE GMBH, Hanover (DE)

( * ) Notice: Subject to any disclaimer, the term of this patent is extended or adjusted under 35 U.S.C. 154(b) by 201 days.

(21) Appl. No.: 14/414,686

(22) PCT Filed: Jul. 4, 2013

(86) PCT No.: PCT/EP2013/064106
§ 371 (c)(1),
(2) Date: Jan. 13, 2015

(87) PCT Pub. No.: WO2014/009237
PCT Pub. Date: Jan. 16, 2014

(65) Prior Publication Data

US 2015/0211456 A1 Jul. 30, 2015

(30) Foreign Application Priority Data

Jul. 13, 2012 (DE) ..... 10 2012 212 266

(51) Int. Cl.
*F02M 51/06* (2006.01)
*F02M 61/10* (2006.01)
*F02M 61/16* (2006.01)

(52) U.S. Cl.
CPC ..... *F02M 51/0603* (2013.01); *F02M 61/10* (2013.01); *F02M 61/167* (2013.01); *F02M 2200/703* (2013.01); *F02M 2200/708* (2013.01)

(58) Field of Classification Search
CPC ..... F02M 2200/703; F02M 2200/705; F02M 2200/708; F02M 47/027; F02M 51/0603;
(Continued)

(56) References Cited

U.S. PATENT DOCUMENTS 4,813,601 A * 3/1989 Schwerdt ..... F02M 57/02 123/446
4,858,439 A * 8/1989 Sawada ..... F02M 51/0603 239/102.2
(Continued)

FOREIGN PATENT DOCUMENTS

CA 2473639 A1 11/2004 ..... F02M 61/10
CN 101044313 A 9/2007 ..... F02M 45/08
(Continued)

OTHER PUBLICATIONS

International Search Report and Written Opinion, Application No. PCT/EP2013/064106, 9 pages, Sep. 2, 2013.
(Continued)

*Primary Examiner* — Mahmoud Gimie
*Assistant Examiner* — John Zaleskas
(74) *Attorney, Agent, or Firm* — Slayden Grubert Beard PLLC

(57) ABSTRACT

A fluid injector has a solid state actuator and a control piston unit arranged in a recess of an injector body. A transmission pin mechanically couples the actuator to the control piston unit. A first control chamber, coupled hydraulically to a second control chamber, is delimited by the control piston unit and the injector body. A control piston of the control piston unit has an end surface that is coupled to the transmission pin and which delimits the first control chamber. The control piston unit has a control sleeve arranged coaxially with the control piston and an inwardly directed projection that provides a driving coupling between the control piston and the control sleeve after a predefined control stroke of the control piston. The driving coupling results in the control piston influencing a free volume of the first control chamber during an axial movement of the control piston.

8 Claims, 3 Drawing Sheets

(58) Field of Classification Search
CPC .. F02M 61/10; F02M 61/167; F02M 63/0026; F02M 63/0033; F02M 63/0035; F02M 63/0036
USPC ..... 123/472, 498; 239/102, 533.2, 533.7, 239/533.9, 585.5; 251/57
See application file for complete search history.

(56) References Cited

U.S. PATENT DOCUMENTS

| | | | | |
|---|---|---|---|---|
| 5,697,554 | A * | 12/1997 | Auwaerter | F02M 51/0603 239/584 |
| 6,168,132 | B1 * | 1/2001 | Frank | F02M 47/027 123/467 |
| 6,290,204 | B1 * | 9/2001 | Kienzler | F02M 63/0026 251/129.19 |
| 6,302,333 | B1 * | 10/2001 | Hoffmann | F02M 51/0603 239/102.2 |
| 6,679,440 | B2 * | 1/2004 | Igashira | F02M 47/027 239/533.2 |
| 6,739,575 | B2 * | 5/2004 | Cotton | F02M 47/027 251/129.06 |
| 6,832,749 | B2 * | 12/2004 | Schuerg | F02M 47/00 251/129.06 |
| 7,290,530 | B2 * | 11/2007 | Boecking | F02M 47/027 123/467 |
| 7,429,815 | B2 | 9/2008 | Gibson et al. | 310/344 |
| 7,527,210 | B2 | 5/2009 | Ricco et al. | 239/96 |
| 7,898,152 | B2 | 3/2011 | Stocker et al. | 310/328 |
| 7,926,737 | B2 | 4/2011 | Stoecklein et al. | 239/96 |
| 8,201,543 | B2 * | 6/2012 | Morris | F02M 51/0603 123/494 |
| 8,998,115 | B2 | 4/2015 | Salcedo et al. | 239/585.2 |
| 2002/0005188 | A1 | 1/2002 | Murakami et al. | 123/506 |
| 2002/0134954 | A1 * | 9/2002 | Kienzler | F02M 47/025 251/57 |
| 2004/0079815 | A1 | 4/2004 | Hohl | 239/102.2 |
| 2006/0169802 | A1 * | 8/2006 | Pauer | F02M 51/0603 239/533.2 |
| 2007/0131800 | A1 | 6/2007 | Boecking | 239/533.2 |
| 2007/0283803 | A1 | 12/2007 | Moritz | 92/34 |
| 2008/0093482 | A1 * | 4/2008 | Boecking | F02M 45/04 239/585.5 |
| 2008/0093483 | A1 | 4/2008 | Boecking | 239/585.5 |
| 2009/0266921 | A1 * | 10/2009 | Boecking | F02M 51/0603 239/585.5 |
| 2010/0006675 | A1 * | 1/2010 | Boecking | F02M 51/0603 239/533.2 |
| 2012/0160214 | A1 * | 6/2012 | Salcedo | F02M 51/0603 123/446 |

FOREIGN PATENT DOCUMENTS

| | | | | |
|---|---|---|---|---|
| CN | 101054942 | A | 10/2007 | F02M 61/20 |
| CN | 201090729 | Y | 7/2008 | F16J 3/04 |
| CN | 101331312 | A | 12/2008 | F02M 47/02 |
| DE | 242680 | A1 | 2/1987 | G01L 19/14 |
| DE | 10007733 | A1 | 8/2001 | F02M 51/06 |
| DE | WO 2005050002 | A1 * | 6/2005 | F02M 51/0603 |
| DE | WO 2005095787 | A1 * | 10/2005 | F02M 45/086 |
| DE | WO 2006008200 | A1 * | 1/2006 | F02M 51/0603 |
| DE | 102004044811 | A1 * | 3/2006 | F02M 47/027 |
| DE | 102005008972 | A1 * | 8/2006 | F02M 47/02 |
| DE | 102005008973 | A1 * | 8/2006 | F02M 51/0603 |
| DE | 102005015733 | A1 * | 10/2006 | F02M 45/12 |
| DE | 102005016795 | A1 * | 10/2006 | F02M 51/0603 |
| DE | 102005040914 | A1 * | 3/2007 | F02M 51/0603 |
| DE | 102006043027 | A1 | 3/2008 | H01L 41/053 |
| DE | 102007016626 | A1 | 10/2008 | B05B 1/00 |
| DE | 102008047385 | A1 * | 3/2010 | F02M 51/0603 |
| DE | 102009027504 | A1 | 1/2011 | F02M 47/02 |
| DE | 102009039647 | A1 | 3/2011 | F02M 47/02 |
| DE | 102010040874 | A1 | 3/2012 | F02M 47/02 |
| EP | 1637727 | A1 * | 3/2006 | F02M 47/027 |
| JP | 5245522 | A | 9/1993 | B21B 39/00 |
| WO | WO 2010142753 | A1 * | 12/2010 | F02M 51/0603 |
| WO | WO 2010142767 | A1 * | 12/2010 | F02M 51/0603 |
| WO | 2014/009228 | A2 | 1/2014 | F02M 51/06 |
| WO | 2014/009237 | A1 | 1/2014 | F02M 51/06 |

OTHER PUBLICATIONS

International Search Report and Written Opinion, Application No. PCT/EP2013/064074, 15 pages, Jan. 30, 2014.
Chinese Office Action, Application No. 201380037483.6, 12 pages, dated Jul. 4, 2016.
Chinese Office Action, Application No. 201380037481.7, 11 pages, dated Apr. 5, 2017.

* cited by examiner

FLUID INJECTOR

CROSS-REFERENCE TO RELATED APPLICATIONS

This application is a U.S. National Stage Application of International Application No. PCT/EP2013/064106 filed Jul. 4, 2013, which designates the United States of America, and claims priority to DE Application No. 10 2012 212 266.4 filed Jul. 13, 2012, the contents of which are hereby incorporated by reference in their entirety.

TECHNICAL FIELD

The invention concerns a fluid injector with a solid state actuator which for example may be a piezoelectric actuator. Such fluid injectors are used for example for metered supply of fuel in internal combustion engines. In view of the high requirements for internal combustion engines arranged in motor vehicles, such as for example in relation to a very specific power settings and/or to meet strict emissions limits, a precise metering of the fuel by means of the fluid injector is important.

BACKGROUND

In this context, in particular in diesel internal combustion engines, fluid injectors with solid state actuators are used. The fluid to be metered, for example in the case of diesel, is frequently supplied to the injector with a feed pressure of up to around 2500 bar and then metered by means of the fluid injector into the respective combustion chamber of the internal combustion engine.

In this context it is known to use fluid injectors in which an opening or closing of a nozzle needle of the fluid injector is controlled by means of a servo valve, which is brought into its different switch positions by means of a solid state actuator.

In addition, there are also designs for such fluid injectors in which such a servo valve is omitted and for example a stroke of the solid state actuator is transmitted to the nozzle needle by means of one or more suitably configured levers.

SUMMARY

One embodiment provides a fluid injector, comprising a solid state actuator; an injector body which has an actuator recess in which the solid state actuator is arranged; a control piston unit which is arranged in a control piston unit recess of the injector body; and a transmission pin which is arranged such that it penetrates a transmission pin recess in the injector body and mechanically couples the solid state actuator to the control piston unit. A first control chamber is delimited by the control piston unit and injector body, and the first control chamber is hydraulically coupled to a second control chamber. A nozzle body is provided having a nozzle body recess in which, in a region of a nozzle tip of the nozzle body, one or more injection holes are formed penetrating the nozzle body towards the outside. A nozzle needle is arranged in the nozzle body recess and has a face facing away from the needle tip which delimits the second control chamber. The nozzle needle is arranged axially moveably in the nozzle needle recess such that in a closed position it prevents a fluid flow through the one or more injection holes and otherwise allows this. The control piston unit comprises: a control piston which, at an axial end facing the transmission pin, has a face which is coupled to the transmission pin and delimits the first control chamber; and a control sleeve which is arranged coaxially to the control piston and has a radially inwardly directed protrusion, via which a carrier coupling takes place between the control piston and the control sleeve after overcoming a predefined first piston stroke of the control piston caused by an elongation of the solid state actuator which is due to the supply of electrical energy, wherein the control sleeve is arranged and configured such that during an axial movement of the control piston with the existing carrier coupling, it influences a free volume of the first control chamber.

In a further embodiment, the control piston, at its axial end facing away from the transmission pin, is coupled to an expansion chamber which is pressurized stationarily with a feed pressure of the fluid to be metered and in which a spring element is arranged, such that a force directed towards the transmission pin is exerted on the control piston.

In a further embodiment, the control sleeve comprises a first part and a second part, wherein the second part has the radially inwardly directed protrusion and the first part is arranged in the axial direction closer to the transmission pin than the second part, and the first part and the second part are hydraulically coupled in the axial direction via a coupling chamber and mechanically coupled by means of a spring element arranged in the coupling chamber.

In a further embodiment, a thrust piece is assigned to the control piston which is arranged axially in the region of the radially inwardly directed protrusion of the control sleeve, has a collar element with a larger cross section than the radially inwardly directed protrusion of the control sleeve, and is arranged axially on the end of the control sleeve facing away from the transmission pin.

In a further embodiment, the collar element is configured as a separate part of the thrust piece.

BRIEF DESCRIPTION OF THE DRAWINGS

Example embodiments of the invention are explained in more detail below with reference to the diagrammatic drawings, in which.

DETAILED DESCRIPTION

Figure 1:
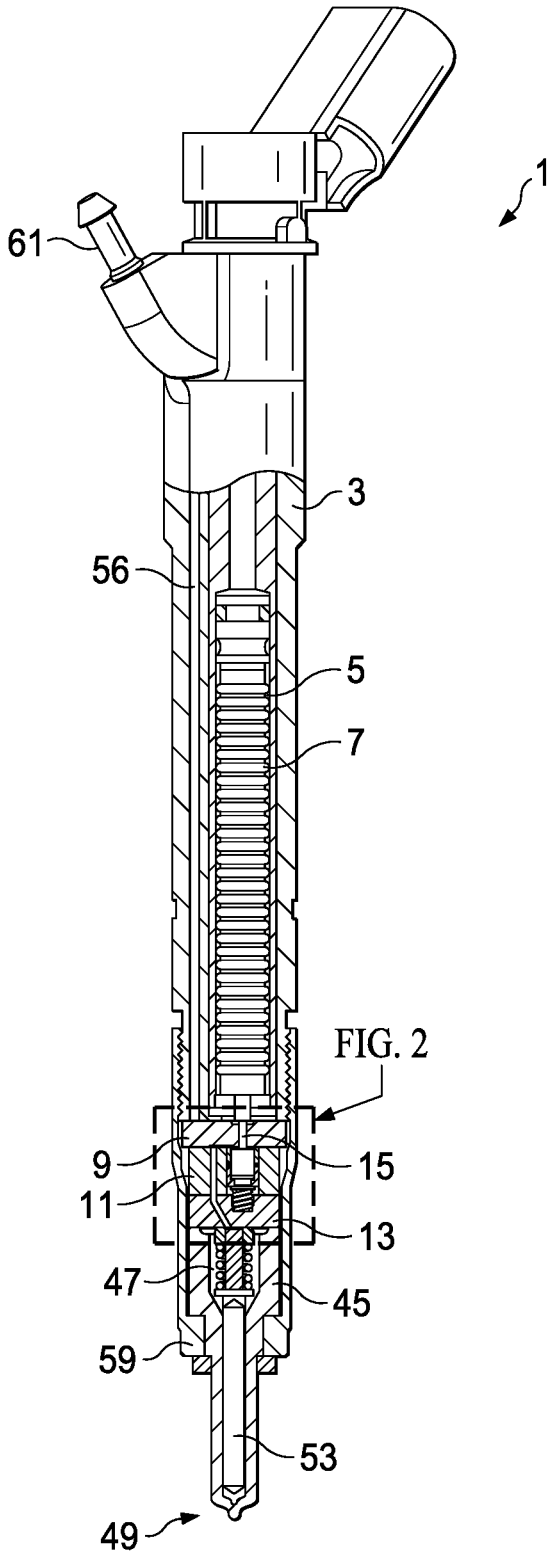
FIG. 1 shows a partial cross section through a fluid injector.
Figure 2:
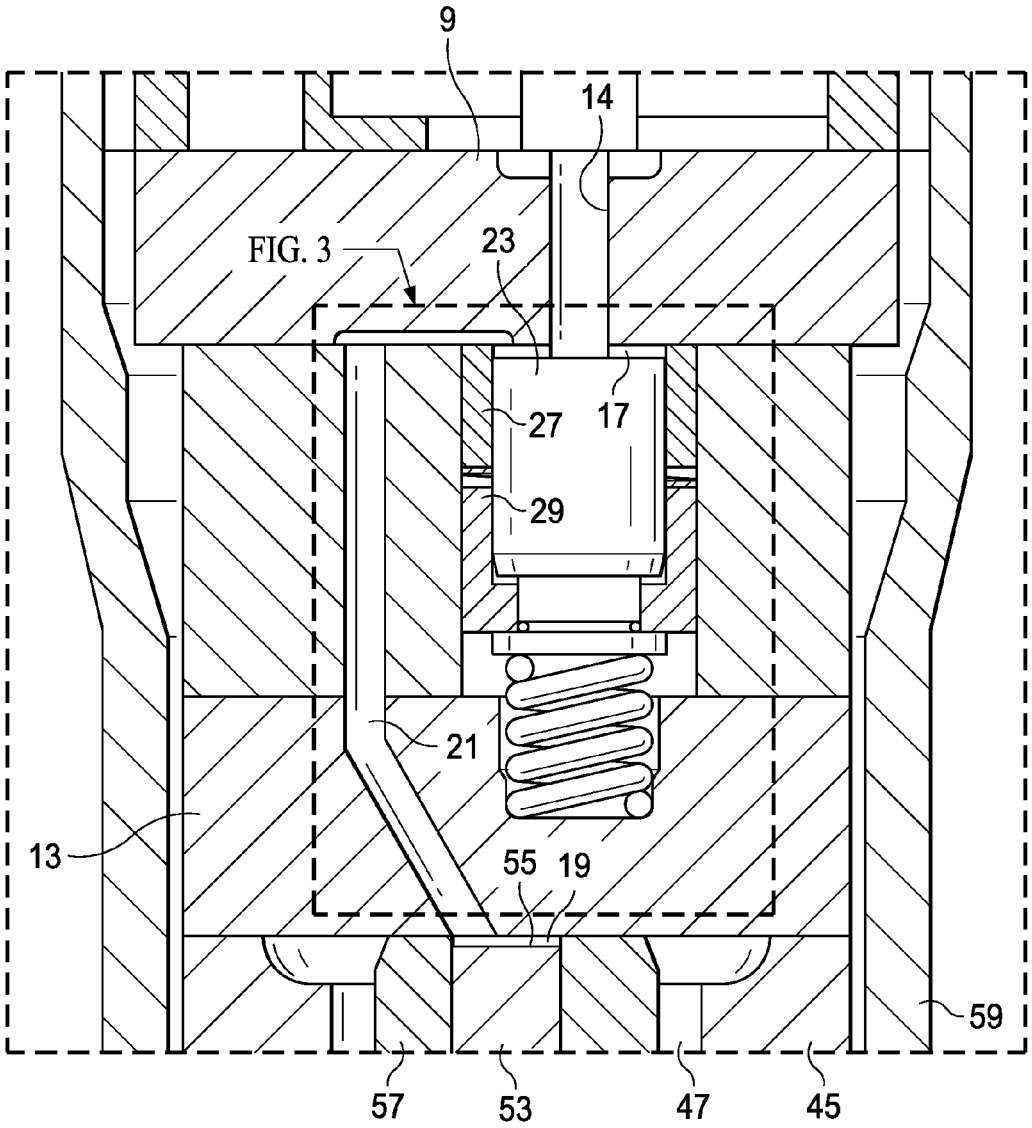
FIG. 2 shows a first partial extract in a cross section view of the fluid injector in FIG. 1.

Embodiments of the invention provide a fluid injector which contributes to a reliable and efficient operation.

According to one embodiment, a fluid injector includes a solid state actuator and an injector body. The injector body has an actuator recess in which the solid state actuator is arranged. Furthermore it has a control piston unit which is arranged in a control piston unit recess of the injector body. A transmission pin is provided which is arranged such that it penetrates a transmission pin recess in the injector body and mechanically couples the solid state actuator to the control piston unit. The control piston unit and injector body delimit a first control chamber which is hydraulically coupled to a second control chamber.

Furthermore the fluid injector comprises a nozzle body having a nozzle body recess in which, in a region of a nozzle tip, one or more injection holes are formed penetrating the nozzle body towards the outside.

A nozzle needle is arranged in the nozzle body recess and has a face facing away from the nozzle tip which delimits the second control chamber. The nozzle needle is arranged axially moveably in the nozzle body recess. In a closed position it prevents a fluid flow through the one or more injection holes and otherwise allows this.

The control piston unit has a control piston which, at one axial end facing the transmission pin, has a face which is coupled to the transmission pin and delimits the first control chamber.

Furthermore, the control piston unit has a control sleeve which is arranged coaxially to the control piston and has a radially inwardly directed protrusion, via which a carrier coupling may take place between the control piston and the control sleeve after overcoming a predefined first control piston stroke of the control piston caused by an elongation of the solid state actuator which is due to the supply of electrical energy. The control sleeve is arranged and configured such that during an axial movement of the control piston with the existing carrier coupling, it influences a free volume of the first control chamber.

In this way a two-stage translation ratio is achieved of a force change which is caused by an elongation of the solid state actuator and transmitted to the control piston unit via a transmission pin, relative to the force change which results from the hydraulic coupling between the first and second control chamber and acts on the nozzle needle. Thus the translation ratio during the first control piston stroke of the control piston is smaller than after overcoming the predefined control piston stroke and subsequent carrier coupling between the control piston and control sleeve.

To move the nozzle needle out of its closed position requires a particularly great reduction in the force which is introduced into the nozzle needle by means of the fluid pressure, via the face of the nozzle needle facing away from the nozzle needle tip, namely because in the closed position of the nozzle needle, only a small force is exerted on a region of a nozzle needle tip which lies radially inside a seat of the nozzle needle, since in this region the fluid pressure corresponds approximately to ambient pressure. The seat of the nozzle needle lies radially outside the injection holes.

Due to the provision of a smaller translation ratio during the first control piston stroke, at the cost of an overall greater stroke for moving the nozzle needle out of its closed position, to this end a smaller force must be built up than with a larger translation ratio. This has the advantage that as a whole, a smaller charge need be applied to the solid state actuator.

In the following phase of movement of the nozzle needle out of its closed position, a correspondingly required stroke of the nozzle needle can be achieved because of the high fluid pressure then acting on the nozzle needle tip, with the increased translation ratio due to the carrier coupling. Thus during the existence of the carrier coupling, a free volume of the control chamber is influenced both by the control piston and by the control sleeve. In this way during an entire fluid metering process, the solid state actuator can be operated particularly efficiently and where applicable can also be dimensioned more compactly than in the case in which no two-stage translation ratio is applied.

This is advantageous in particular if particularly small fluid quantities must be metered in succession at very short time intervals, as is the case for example with multiple injections. In this case, a smaller charge quantity is applied to the solid state actuator and can therefore be discharged again from this more quickly, which has the consequence that particularly short intervals can be achieved between the individual fluid doses.

In addition, this avoids a high elastic pre-tension on the drive system of the fluid injector, comprising the entire mechanical/hydraulic coupling path starting from the solid state actuator to the nozzle needle, which leads to steep quantity curves in the smallest quantity region, in particular because after the nozzle needle has lifted from its seat, the total hydraulic closing force acting on the needle falls rapidly and otherwise the nozzle needle would be accelerated very strongly in the direction towards the solid state actuator. Precisely this effect is however significantly damped by the two-stage translation ratio of the fluid injector.

In particular, the first and also the second control chambers are pressurized stationarily during operation of the fluid injector with the feed pressure of the fluid which is supplied to the fluid injector for metering the fluid.

According to one embodiment, at its axial end away from the transmission pin, the control piston of the control piston unit is coupled to an expansion chamber which is pressurized stationarily with a feed pressure of the fluid and in which a spring element is arranged, such that a force directed towards the transmission pin is exerted on the control piston. This contributes in particular to hydraulic play compensation.

The use of the fluid injector under thermally highly complex peripheral conditions with various heat sources and heat sinks, as is the case for example in internal combustion engines, constitutes a great challenge because of the different thermal behavior of the solid state actuator and other elements of the fluid injector, such as for example the injector body, nozzle needle and nozzle body. In this context the fluid injector is also greatly influenced thermally by an intrinsic heating due to electrical losses in the region of the solid state actuator. A temperature increase due to expansion of the fluid from feed pressure to ambient pressure plays a significant role in the region of the injection hole or holes. In addition, on use of the fluid injector in a cylinder head of an internal combustion engine, corresponding heat flows occur via contact points and the contact of the nozzle tip with the combustion gases. In particular in a highly dynamic operation of the fuel injector, due to non-stationary and non-homogenous temperature distributions in the individual components of the fluid injector, additional parameters apply to the idle stroke of the solid state actuator which would be necessary without hydraulic play compensation. In addition, in such cases the idle stroke changes during operation of the fluid injector due to length changes of the solid state actuator resulting from polarization changes and component wear.

By the provision of the expansion chamber which is pressurized stationarily with the feed pressure of the fluid and in which a spring element is arranged, such that a force directed towards the transmission pin is exerted on the control piston and the hydraulic force thus also exerted on the control piston, a contribution can be made to the hydraulic play compensation and also a contribution to a reliable coupling, independent of said thermal influences, between the solid state actuator and the control piston by means of the transmission pin.

According to a further embodiment, the control sleeve comprises a first part and a second part. The second part has the radially inwardly directed protrusion. The first part is arranged in the axial direction closer to the transmission pin than the second part. The first part and second part are hydraulically coupled in the axial direction via a coupling chamber. Furthermore they are mechanically coupled by means of a spring element arranged in the coupling chamber.

In this way it can be ensured particularly effectively that the predefined first control piston stroke may be retained even under corresponding thermal conditions.

According to a further embodiment, a thrust piece is assigned to the control piston which is arranged axially in the region of the radially inwardly directed protrusion of the control sleeve, has a collar element with a greater cross section than the radially inwardly directed protrusion of the control sleeve, and is arranged axially on the end of the control sleeve facing away from the transmission pin. In this way it can be ensured that the predefined first control piston stroke may be maintained as precisely as possible, even under said thermal peripheral conditions. This can be achieved particularly effectively if the control sleeve comprises the corresponding first and second parts, and the collar is pressurized with the feed pressure in the expansion chamber, and also the force exerted by the spring element present in the expansion chamber is introduced accordingly into the control piston via the collar and the thrust piece.

According to a further embodiment, the collar element is configured as a separate part of the thrust piece. This has corresponding benefits for production technology and installation.

A fluid injector 1 has an injector body which in principle is formed of one piece, but preferably of several pieces. Thus the injector body in a multi-piece configuration comprises an injector body part 3, an intermediate plate 9, a control plate 11 and an end plate 13.

The injector body part 3 has an actuator recess 5 in which a solid state actuator 7 is accommodated. The solid state actuator 7 is configured for example as a piezoelectric actuator and is an electromechanical converter.

The injector body, in particular the injector body part 3, need not necessarily fulfill a temperature compensation function and may therefore be made from a material which can be optimized with regard to high compressive strength.

The region of the solid state actuator 7 which actively contributes to the length change of the solid state actuator following the supply or discharge of electrical charge, therefore in particular the piezostack in the case of a piezoelectric actuator, is for example hermetically separated from the fluid by means of a membrane or corrugated pipe.

Furthermore a control piston unit recess, in which a control piston unit is arranged, is formed in particular in the control plate 11.

Furthermore a transmission pin recess 14 is provided in the intermediate plate 9, which penetrates this in particular axially and namely towards the control piston unit recess in the control plate 11. A transmission pin 15 is arranged in the transmission pin recess 14 such that it penetrates the transmission pin recess and mechanically couples the solid state actuator 7 to the control piston unit.

The control piston unit delimits a first control chamber 17. The first control chamber 17 is hydraulically coupled to a second control chamber 19, namely via a connecting bore 21. The control piston unit has a control piston 23 which, at one axial end facing the transmission pin 15, has a face 25 which is coupled to the transmission pin 15 and delimits the first control chamber 17.

Furthermore the control piston unit has a control sleeve which is arranged coaxially to the control piston 23. The control sleeve has a first part 27 and a second part 29. The second part 29 of the control sleeve has a radially inwardly directed protrusion 35, via which a carrier coupling is achieved between the control piston 23 and the control sleeve after overcoming a predefined first control piston stroke of the control piston 23 caused by an elongation of the solid state actuator 7 due to the supply of electrical energy.

The control sleeve is arranged and configured so that during an axial movement of the control piston 23, with the existing carrier coupling, it influences a free volume of the first control chamber 17. The first part 27 of the control sleeve is arranged closer in the axial direction to the transmission pin 15 than the second part 29 of the control sleeve. The first part 27 and the second part 29 are hydraulically coupled in the axial direction via a coupling chamber 31 and mechanically coupled by means of a spring element 33 arranged in the coupling chamber 31.

A thrust piece 37 is assigned to the control piston 23 which is arranged axially in the region of the radially inwardly directed protrusion 35 of the control sleeve, has a collar element 39 with a larger cross section than the radially inwardly directed protrusion 35 of the control sleeve, and is then arranged axially on the end of the control sleeve facing away from the transmission pin 15. The collar element 39 may be configured as a separate part of the thrust piece 37 but it may also be formed integrally or of one piece with this.

Furthermore in the control plate 11 and end plate 13, an expansion chamber is formed which is pressurized stationarily with the feed pressure of the fluid and in which a spring element 41 is arranged, such that it exerts a force on the control piston directed towards the transmission pin 15. The spring element 41 in this context is arranged so that it transmits a force via the collar element 39 onto the control piston unit, and thus in particular via the thrust piece 37 onto the control piston 23. In addition a hydraulic force acting in the direction of the transmission pin 15 acts on the control piston 23 via the collar element 39. This decisively contributes to a reliable coupling between the solid state actuator 7 and the control piston 23 by means of the transmission pin 15, in the sense of a hydraulic play compensation.

Furthermore a nozzle body 45 is provided which has a nozzle body recess 47. One or more injection holes are formed in the nozzle body recess 47 in a region 49 of a nozzle tip, and penetrate the nozzle body 45 towards the outside starting from the nozzle body recess 47. A nozzle needle 53 is arranged in the nozzle body recess 47 and, with a face 55 facing away from the nozzle tip, delimits the second control chamber 19.

The nozzle needle 53 is arranged axially moveably in the nozzle body recess 47 such that in a closed position, it prevents a fluid flow through the one or more injection holes and otherwise allows this. In addition, a feed bore 56 is provided in the injector body part 3 and also the intermediate plate 9, control plate 11 and end plate 13, and is hydraulically coupled to a fluid connection 61 which is itself hydraulically coupled to a fluid supply during operation, and by means of which, during operation of the fluid injector 1, the fluid to be metered is supplied to said injector under the feed pressure.

The transmission pin 15 is fitted into the transmission pin recess 14 with very slight play, such that as little fluid leakage as possible takes place from the first control chamber 17 through the transmission pin recess 14, and thus a practical hydraulic tightness exists in relation to the highly dynamic processes in the control chamber 17. In addition a pairing play for the control piston 23 in the control sleeve, i.e. in the first and second parts 27 and 29, is selected so small that a practical tightness can be guaranteed for the highly dynamic processes in the control chamber 17. This also applies to the coupling chamber 31 and the expansion chamber 43. With regard to relatively slower drift processes provoked by different temperature expansion coefficients of the components concerned, or different temperatures in the components at different locations, consequently a pressure compensation can take place i.e. for example between the first control chamber 17 and/or the coupling chamber 31 and/or the expansion chamber 43, and thus a hydraulic play compensation can take place. The pairing plays to be provided are for example around 2 to 6 μm; at the transmission pin 15 in the transmission pin recess, the pairing play is less than 2 μm.

The first control chamber and the second control chamber, the coupling chamber 31 and the expansion chamber 43, are pressurized stationarily with the feed pressure.

The nozzle body 45 is coupled to the injector body via a nozzle clamping nut 59.

The second control chamber 19 is furthermore delimited by means of a nozzle needle sleeve 47 which is arranged coaxially to the nozzle needle 53.

Figure 3:
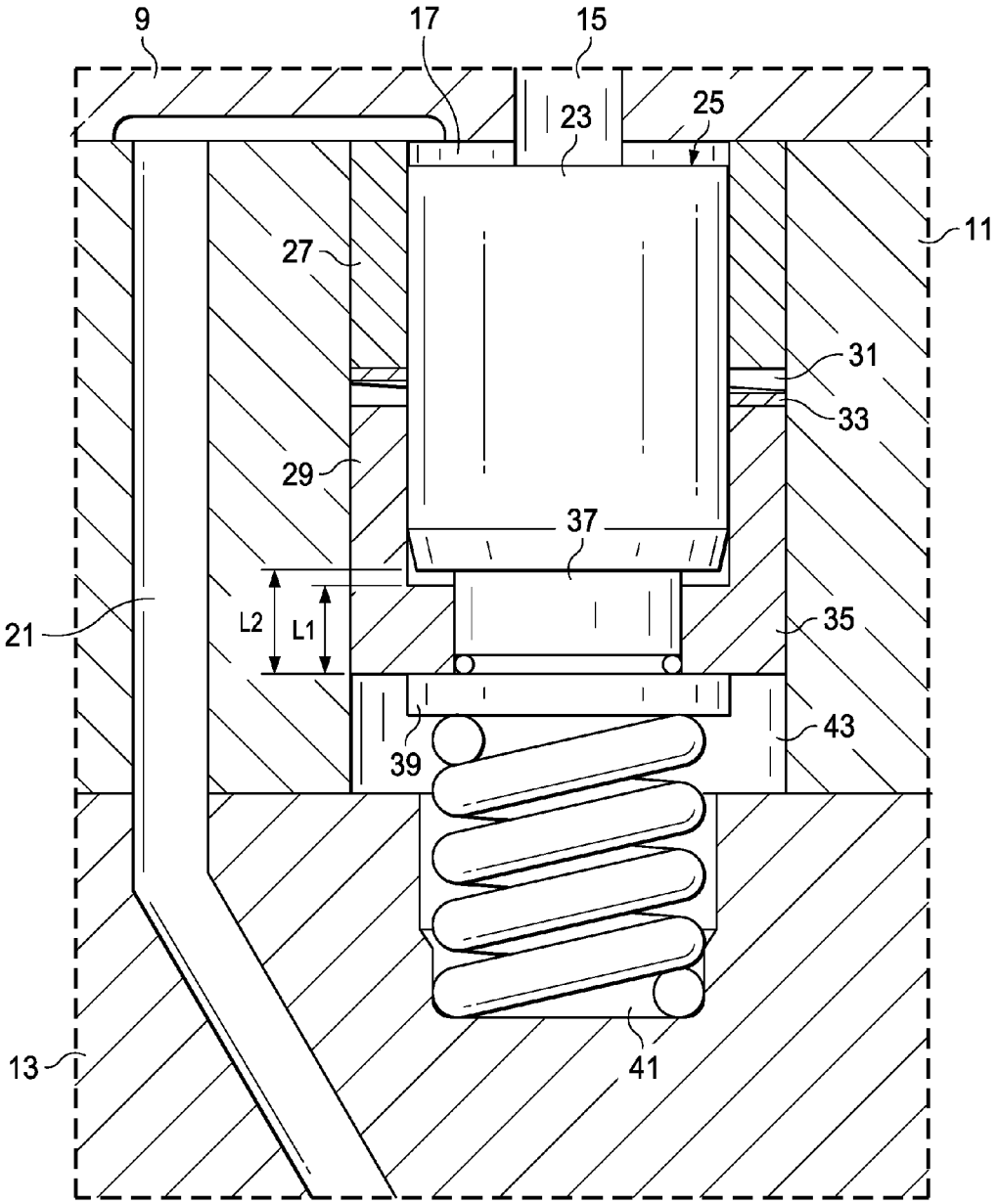
FIG. 3 shows a second partial extract in relation to the first partial extract of the fluid injector in a further enlarged depiction.

The function method of the fluid injector is explained in more detail below. By a movement of the control piston 23 in a direction towards the nozzle tip, a pressure fall is produced in the first control chamber 17 which is transmitted to the second control chamber 19 via the connecting bore 21. If the pressure in the second control chamber 21 then falls below a predefined threshold value, a resulting force acts on the nozzle needle 53 in the direction away from the nozzle tip, with the consequence that the nozzle 53 lifts away from its seat and hence leaves its closed position. Here the first control piston stroke is the difference between L1 and L2 (see FIG. 3). It is predefined so that preferably the carrier coupling takes place when the resulting force acting on the nozzle needle 53 has changed its prefix, such that the nozzle needle 53 leaves its closed position.

As a result, on a further supply of electrical energy to the solid state actuator 7, the carrier coupling takes place between the control piston 23 and the control sleeve. The second part 29 of the control sleeve is then moved further with the control piston 23, which initially leads to a pressure fall in the coupling chamber 31. In particular when the pressure in the coupling chamber 31 is lower than the pressure in the first control chamber 17, the first part 27 of the control sleeve also moves with the control piston 23 and thus influences the free volume of the first control chamber. The hydraulically active cross section in the first control chamber 17 then increases accordingly. Thus the translation ratio between the respective elongation of the solid state actuator 7 and the assigned movement of the nozzle needle rises to a value which results from the ratio of the cross section of the outer diameter of the first part 27 of the control sleeve minus the cross section of the connecting pin 15 and the cross section of the face 55 of the nozzle needle.

It is particularly advantageous if this translation ratio is particularly large, for example set to a value of around 2.0. In this way the necessary nozzle needle stroke can be achieved with a possible solid state actuator stroke. In this range of movement of the nozzle needle 53, a necessary force to be applied by the solid state actuator 7 no longer constitutes a limiting value, since in this state a hydraulically active closing force of the nozzle needle 53 has already fallen so greatly that the feed pressure at its tip acts completely on said needle.

Before the first part 27 of the control sleeve moves as a result of the carrier coupling with the control piston 23, the translation ratio is given by the cross section of the control piston 23 minus the cross section of the transmission pin 15, to the cross section of the face 55 of the nozzle needle 53. In this state, this translation ratio is particularly advantageously selected small, for example between 0.9 to 1.1.

For the return of the nozzle needle 53 to its closed position, the solid state actuator 7 is discharged again. This has the consequence that the fluid pressure in the first control chamber 17 rises again to the feed pressure and thus, also due to the hydraulic coupling with the connecting bore 21, the pressure in the second control chamber 19 rises accordingly. Consequently, the resulting force acting on the nozzle needle 53 moves this back again into its seat and hence into its closed position.

Due to the spring element 33 which is in particular formed as a spring washer, it is ensured that in a starting position, i.e. when the nozzle needle is in its closed position, the first part 27 of the control sleeve is at a stop on the intermediate plate 9 and the second part 29 of the control sleeve is still at the stop on the collar element 39.

As already stated, the force exerted by the spring element 41 leads continuously to a direct coupling of the control piston 23 with the leakage pin 15. In this way a play-free drive is guaranteed.

By a relative change of reference position on the solid state actuator 7 at which this is coupled to the leakage pin 15, and which is designated for example the base plate position, a height of the first control chamber 17 changes as a result of temperature changes in particular due to different thermal expansion coefficients. However the drive remains play-free. Correspondingly, the height of the coupling chamber 31 changes. This means that the play compensation is effective on the control sleeve. Thus the predefined first control piston stroke is not influenced, in particular is largely not influenced, by temperature effects.

By a return of the hydraulic force onto the solid state actuator 7, sensor signals can be generated which can be used to build a closed control loop for a fluid quantity to be metered.

Characteristic force jumps occur on lifting of the nozzle needle from its seat, on transition from the first to the second translation stage, and on closure of the nozzle needle 53. In the case of a needle stop (limiting of needle stroke), a measurable force change also occurs on reaching the stop.

Due to this two-stage translation ratio, in particular with integral play compensation, a reduction can be achieved in the charge quantity which must be applied to the solid state actuator at the time of opening of the nozzle needle 53, when the nozzle needle 53 leaves its closed position.

In addition, as small as possible an interval between two fluid doses can be reduced compared with the situation without a two-stage translation ratio. In this way a very great quantity precision can be achieved when metering minute quantities of fluid. In addition there is also a fixed assignment of translation ratio to nozzle needle stroke. Furthermore a necessary stroke of the solid state actuator to achieve the required stroke of the nozzle needle 53 can thus be kept relatively small. Furthermore, in this way compensation takes place for length changes resulting from wear at the contact points during drive. Moreover, length changes of the solid state actuator as a result of changes in polarization state can be compensated. In this way a contribution can be made to a very high injection quantity stability on metering of the fluid even in dynamic operation, in particular dynamic engine operation.

What is claimed is:

1. A fluid injector comprising:

a solid state actuator;

an injector body including an actuator recess in which the solid state actuator is arranged;

a control piston having a longitudinal axis, two circular end faces extending transverse to the longitudinal axis, and a cylindrical side surface arranged in a control piston unit recess of the injector body;

a transmission pin penetrating a transmission pin recess in the injector body and in direct contact with one of the two circular end faces of the control piston;

a first control chamber delimited between the one of the two circular end faces of the control piston and an intermediate plate;

a connecting bore through the intermediate plate hydraulically coupling the first control chamber to a second control chamber;

a nozzle body having a nozzle body recess including, in a region of a nozzle tip of the nozzle body, one or more injection holes that penetrate the nozzle body towards the outside;

a nozzle needle arranged in the nozzle body recess, the nozzle needle having a first face facing away from the needle tip delimiting the second control chamber;

wherein the nozzle needle is arranged axially moveably in the nozzle needle recess such that the nozzle needle prevents a fluid flow through the one or more injection holes in a closed position of the nozzle needle, and allows the fluid flow through the one or more injection holes in other positions of the nozzle needle; and the control piston coupled to the transmission pin; and a control sleeve arranged coaxially with the control piston, the control sleeve including a first part proximate the intermediate plate and in sliding contact with the cylindrical side surface of the control piston and a second part separated from the first part by a spring element in a coupling chamber space, the second part of the control sleeve including a radially inwardly directed protrusion that provides a carrier coupling between the control piston and the control sleeve after a predefined first piston stroke of the control piston caused by an elongation of the solid state actuator due to the supply of electrical energy, the carrier coupling defining a coupled state of the control piston, such that during an axial movement of the control piston in the coupled state of the control piston, movement of the first part of the control sleeve away from the intermediate plate increases a free volume of the first control chamber.

2. The fluid injector of claim 1, wherein the circular end face of the control piston facing away from the transmission pin is coupled to an expansion chamber which is pressurized stationarily with a feed pressure of the fluid to be metered and in which a spring element is arranged, such that a force directed towards the transmission pin is exerted on the control piston.

3. The fluid injector of claim 1, comprising a thrust piece assigned to the control piston and arranged axially in a region of the radially inwardly directed protrusion of the control sleeve, wherein the thrust piece comprises a collar element having a larger cross section than the radially inwardly directed protrusion of the control sleeve, and wherein the thrust piece is arranged axially on an end of the control sleeve facing away from the transmission pin.

4. The fluid injector of claim 3, wherein the collar element is configured as a separate part of the thrust piece.

5. An internal combustion engine comprising:

a plurality of fluid injectors, each fluid injector comprising:

a solid state actuator;

an injector body including an actuator recess in which the solid state actuator is arranged;

a control piston having a longitudinal axis, two circular end faces extending transverse to the longitudinal axis, and a cylindrical side surface, arranged in a control piston unit recess of the injector body;

a transmission pin penetrating a transmission pin recess in the injector body and in direct contact with one of the two circular end faces of the control piston unit;

a first control chamber delimited by the one of the two circular end faces of the control piston and an intermediate plate;

a connecting bore through the intermediate plate hydraulically coupling the first control chamber to a second control chamber;

a nozzle body having a nozzle body recess including, in a region of a nozzle tip of the nozzle body, one or more injection holes that penetrate the nozzle body towards the outside;

a nozzle needle arranged in the nozzle body recess, the nozzle needle having a first face facing away from the needle tip delimiting the second control chamber;

wherein the nozzle needle is arranged axially moveably in the nozzle needle recess such that the nozzle needle prevents a fluid flow through the one or more injection holes in a closed position of the nozzle needle, and allows the fluid flow through the one or more injection holes in other positions of the nozzle needle; and wherein the control piston unit comprises:

the control piston coupled to the transmission pin and delimiting the first control chamber; and a control sleeve arranged coaxially with the control piston, the control sleeve including first part proximate the intermediate plate and in sliding contact with the cylindrical side surface of the control piston and a second part separated from the first part by a spring element in a coupling chamber space, the second part of the control sleeve comprising a radially inwardly directed protrusion that provides a carrier coupling between the control piston and the control sleeve after a predefined first piston stroke of the control piston caused by an elongation of the solid state actuator due to the supply of electrical energy, the carrier coupling defining a coupled state of the control piston, wherein the control sleeve is arranged such that during an axial movement of the control piston in the coupled state of the control piston, movement of the first part of the control sleeve away from the intermediate plate increases a free volume of the first control chamber.

6. The internal combustion engine of claim 5, wherein for each respective fluid injector, the circular end face of the control piston facing away from the transmission pin is coupled to an expansion chamber which is pressurized stationarily with a feed pressure of the fluid to be metered and in which a spring element is arranged, such that a force directed towards the transmission pin is exerted on the control piston.

7. The internal combustion engine of claim 5, wherein each respective fluid injector comprises a thrust piece assigned to the control piston and arranged axially in a region of the radially inwardly directed protrusion of the control sleeve, wherein the thrust piece comprises a collar element having a larger cross section than the radially inwardly directed protrusion of the control sleeve, and wherein the thrust piece is arranged axially on an end of the control sleeve facing away from the transmission pin.

8. The internal combustion engine of claim 7, wherein for each respective fluid injector, the collar element is configured as a separate part of the thrust piece.

* * * * *